United States Patent [19]

Seberger

[11] Patent Number: 4,907,488

[45] Date of Patent: Mar. 13, 1990

[54] DEVICE FOR SILENCING FIREARMS AND CANNON

[76] Inventor: Oswald P. Seberger, P.O. Box 377, Shingletown, Calif. 96088

[21] Appl. No.: 175,039

[22] Filed: Mar. 29, 1988

[51] Int. Cl.[4] ..... F41F 17/12

[52] U.S. Cl. ..... 89/14.4; 181/223

[58] Field of Search ..... 84/14.4; 181/223, 206

[56] References Cited

U.S. PATENT DOCUMENTS

| | | | |
|---|---|---|---|
| 916,885 | 3/1909 | Maxim | 89/14.4 |
| 958,934 | 5/1910 | Maxim | 89/14.4 |
| 1,004,665 | 10/1911 | Lewis | 89/14.4 |
| 1,017,003 | 2/1912 | Kenney | 89/14.4 |
| 1,066,898 | 7/1913 | Gray | 181/223 |
| 1,111,202 | 9/1914 | Westfall | 89/14.4 |
| 1,427,802 | 9/1922 | Goodwin | 89/14.4 |
| 2,375,617 | 5/1945 | Bourne | 181/223 |
| 2,442,773 | 6/1948 | Mason | 181/223 |
| 2,514,996 | 7/1950 | Faust, Jr. | 181/223 |
| 3,399,597 | 9/1968 | Perrine | 181/223 |
| 3,500,955 | 3/1970 | Werbell | 181/223 |
| 3,677,132 | 7/1972 | Plenge | 89/14.4 |
| 3,748,956 | 7/1973 | Hubner | 89/14.4 |
| 3,776,093 | 12/1973 | Leverance et al. | 89/14.4 |
| 3,913,703 | 10/1975 | Parker | 181/206 |
| 3,948,348 | 4/1976 | Bychinsky | 181/206 |
| 4,291,610 | 9/1981 | Waiser | 89/14.4 |
| 4,341,283 | 7/1982 | Mazzanti | 181/14.4 |
| 4,576,083 | 3/1986 | Seberger, Jr. | 89/14.4 |
| 4,588,043 | 5/1986 | Finn | 89/14.4 |

FOREIGN PATENT DOCUMENTS

| | | | |
|---|---|---|---|
| 602160 | 3/1926 | France | 181/206 |
| 859276 | 12/1940 | France | 181/206 |
| 864735 | 5/1941 | France | 89/14.4 |
| 981869 | 5/1951 | France | 89/14.4 |
| 329403 | 9/1935 | Italy | 181/223 |
| 137829 | 4/1921 | United Kingdom | 181/206 |
| 498775 | 1/1939 | United Kingdom | 89/14.4 |

OTHER PUBLICATIONS

Hecht Zajac, Optics (Fourth Edition), Feb., 1979, page 127.

*Primary Examiner*—Charles T. Jordan
*Assistant Examiner*—Stephen Johnson

[57] ABSTRACT

A cylindrical silencer tube is fastened to the muzzle of a firearm or cannon. A quasi-parabolic reflector placed in front of the gun muzzle directs the main discharge gas and sound wave flow rearward to a tuned chamber behind the gun muzzle. The deflected sound waves strike the rear of the chamber and are directed back towards the next oncoming half cycle of sound waves. When the two out of phase waves collide at the entrance of the tuned chamber a cancellation of the noise occurs.

The second section of the silencer is comprised of a series of chambers and semispherically shaped hollow baffles which direct part of the discharge gas and sound waves in a different and longer path from the main discharge gas and sound waves and then cause them to reunite in a chamber. The two out of phase colliding wave forms cancel each other.

The spacing of the semispherical baffles is such that the discharge sound is raised to ultra sound.

4 Claims, 2 Drawing Sheets

DEVICE FOR SILENCING FIREARMS AND CANNON

BACKGROUND OF THE INVENTION

1. Field of Invention

This invention relates to a firearm and firearm silencer which generally takes the form of baffling and path diversion means for the discharge gases in order to effect their throttling and other interferences of progress of the sound whereby the pressure waves of the gases, and therefore the sound waves are muffled.

2. Description of the Related Art

U.S. Pat. No. 4,576,083 to O. P. Seberger Jr uses a cylindrical tube attached to the end of the gun. Tube contains cylindrical and frusta-conical baffles in series with a central hole in the cylindrical and the frusta-conical baffles. These are so arranged as to divide the flow so that part of the gases and sound waves are deflected outward successively by the conical members, passing through holes in them and then reuniting through a cylindrical member to contact the central gas flow after it has been substantially delayed in action and is out of phase with the main flow so that the two flows collide to dampen one another, thus practically eliminating the noise.

BRIEF DESCRIPTION OF THE PRIOR ART

None of the prior art utilizes the method provided by applicant's invention which consists of separating the central gas and sound wave flow exiting the gun barrel by means of a quasi-parabolic baffle with a centrally located hole and diverting the major portion of the gas and sound waves rearward as the gas and sound flow strikes said quasi-parabolic baffle. The rearward traveling gas and sound waves pass through holes located at the periphery of a threaded fitting that affixes the silencer to the gun barrel. The rearward traveling gas and sound waves continue towards the rear of a tuned chamber at the rearward portion of said threaded fitting and strike a flat annular disc at the rear of the tuned chamber. The gas and sound waves are deflected forward by the flat annular disc towards the entrance end of the tuned chamber where they encounter the next one half cycle of gas and sound waves. When the two out of phase gas and sound waves meet at the entrance of the tuned chamber, they collide thus practically eliminating the noise. The tuned chamber of this invention was not present in my prior patent 4,576,083. Annular slots around the internally threaded end of the silencer in that patent serve only to increase the internal volume of the silencer so that the gases and sound waves are further reduced in pressure. They do not function as a tuned chamber because there is not a quasi-parabolic baffle present to deflect gas and sound waves (gas pressure waves) back into those annular slots.

The use of semispherical baffles with a centrally located hole and holes located at the periphery of said semi-spherical baffle are unique in that the gas and sound waves travelling down the central hole of the silencer strike the area adjacent to the central hole of the baffle since the area adjacent to the central hole is nearly perpendicular to the axis of the silencer, and the gas and sound waves striking the area is deflected rearward at an angle nearly perpendicular to that area, the deflected wave strikes the forward facing side of the adjacent baffle. As the sound wave bounces between the baffle faces, the distance travelled by the gas and sound waves in their progress towards the outer edge of the baffle is greater than it would be if the baffles were of a frusta-conical shape as in the U.S. Pat. No. 4,576,083 to O. P. Seberger Jr. U.S. Pat. No. 4,576,083 uses a cylindrical tube attached to the end of the gun. The tube contains cylindrical and frusta-conical baffles in series with a central hole in the cylindrical and the frusta-conical baffles. These are so arranged as to divide the flow so that part of the gases and sound waves are deflected outward successively by the conical members, passing through holes in them and then reuniting through a cylindrical member to contact the central gas flow after it has been substantially delayed in action and is out of phase with the main flow so that the two flows collide to dampen one another, thus practically eliminating the noise.

With the semispherical baffles the longer distance traveled by the gas and sound waves provide for a longer period of time before the gases and sound waves pass through the holes in the periphery of the semispherical baffles, and enter a chamber where the gas and sound waves reunite with the out of phase central gas and sound wave flow, thus practically eliminating the noise. The semispherical baffle design provides for a silencer design whereby the required delay time for out of phase operation is accomplished in a design of smaller physical dimension than that required by the frusta-conical baffle design.

SUMMARY OF THE INVENTION

The method provided by the applicant's device consists of separating the central gas and sound wave flow exiting the gun barrel through a cylindrical tube O by means of a quasi-parabolic baffle K in the tube with a centrally located hole for the main gas and sound wave flow, as well as for the projectile to pass through. The placement of the parabolic baffle in the Tube O is such that the projectile exiting the gun barrel momentarily blocks the centrally located hole, enabling the major portion of the gas and sound wave flow to strike the face of the quasi-parabolic baffle, thus deflecting the gas and sound wave flow rearward. The rearward flow of gas and sound waves enter holes 5 located at the periphery of a threaded barrel fitting J that affixes the silencer to the gun barrel. The deflected traveling gas and sound waves continue towards the rear of an annular tuned chamber P behind the threaded fitting. The tuned chamber is formed by the side of the threaded barrel fitting, the inner wall of the outside cylindrical tube, a flat annular disc G comprising the rear of the silencer, and an inner hollow cylindrical member H that is affixed to the rearward side of the threaded barrel fitting. The rearward moving gas and sound waves strike said flat disc and are reflected back towards the threaded barrel fitting where they encounter incoming gas and sound waves of the next half cycle. Since the reflected and incoming gas and sound wave flows are out of phase with one another they dampen one another, thus virtually eliminating the sound of the gun firing.

The length of the tuned chamber should be a half wavelength of the average velocity of the sound in the chamber, and may be determined empirically or computed. The computation for the length L of the tuned chamber is:

$$\frac{\text{unsilenced pulse duration} \times \text{velocity of sound}}{2}$$

The length of the chamber is the distance between the rearward side of the threaded barrel fitting and the face of the flat disc. The velocity of sound is the average velocity of the sound in the tuned chamber. A simplified formula for the velocity of sound is: $20.06\sqrt{T}$ meter/-second, where T is the temperature of the gas inside the tuned chamber, measured in degrees Kelvin. In addition to the sound wave cancellation effect of the quasi-parabolic baffle and tuned chamber arrangement described above, applicant also utilizes a semispherical baffle in lieu of a frusta-conical baffle in order to separate the central gas and sound wave flow down through the projectile passageways by means of apertures 1 around the edge of the semi-spherical baffles. The central aperture and apertures around the edge of the semi-spherical baffle are so arranged as to divide the flow in order that part of the gas and sound waves are deflected outward by the semispherical baffles, passing through the apertures at the edge of the baffles, and then entering a chamber where it reunites with the central gas and sound flow after it has been delayed in time sufficiently to be out of phase with the main flow so that the two flows dampen one another, thus further eliminating any remaining sound in the gas and sound waves exiting the silencer.

BRIEF DESCRIPTION OF THE DRAWINGS

Referring now to the Figures there is shown on

FIG. 2 ABCD is a representation of baffles A through D. FIG. 2 W1-W5 is a representation of spacers W1 through W5.

DESCRIPTION OF A PREFERRED EMBODIMENT

Figure 2:
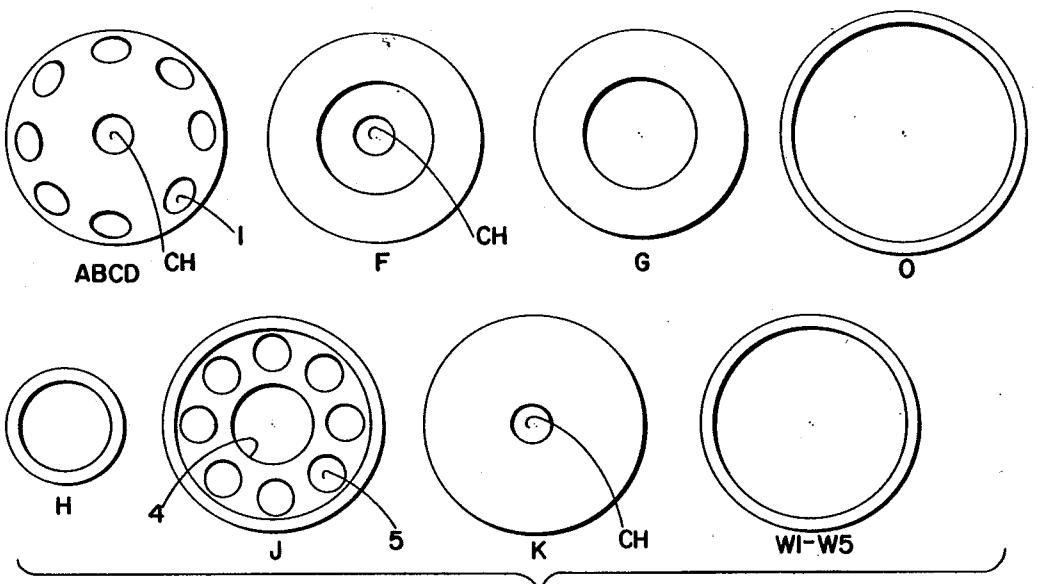
FIG. 2 illustrates in a plan view semi-spherical baffles A, B, C and D as viewed from line E—E shown in FIG. 1, i.e. from the concave side; hollow cylindrical members W1 through W5 which serve as spacers in the silencer shown in FIG. 1, an end view of the silencer tube O, an end view of flat annular disc G, truncated conical flange members F as viewed from along a line E—E, i.e. from the convex sides and a quasi-parabolic baffle member K.
Figure 1:
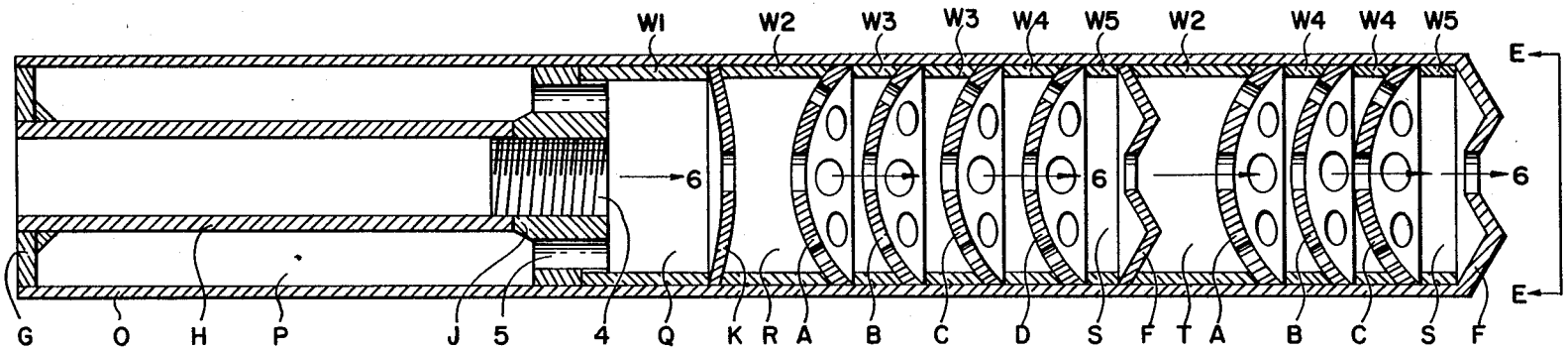
FIG. 1 a schematic longitudinal section through the silencer tube O and shows the annular flat disc G, inner hollow cylindrical member H, barrel fitting J, quasi-parabolic baffle K, semi-spherical baffle A, B, C, D, flange member F, and the spacers W1 through W5.
Figure 4:
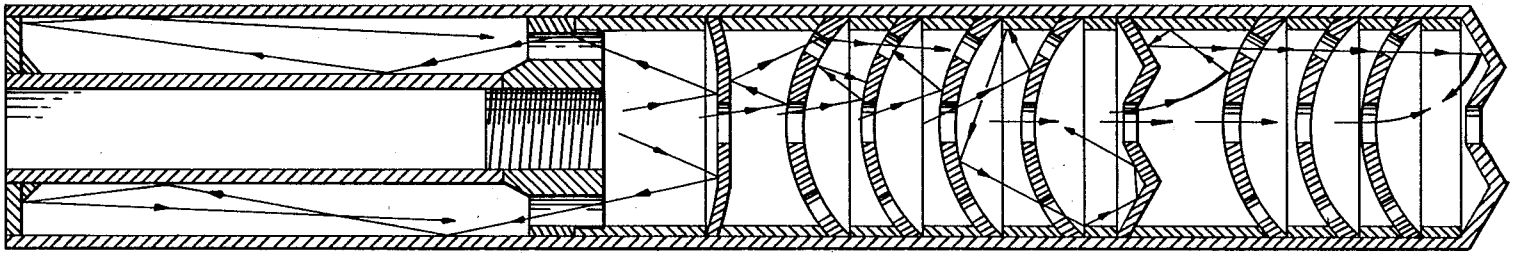
FIG. 4 is a schematic longitudinal section through the silencer tube O and shows the flow of the gases and sound waves.

Referring now to the figures, and especially to FIG. 2 there is shown the component parts, or elements, which comprise the heart of the silencer. These are as follows: A, B, C, and D are semispherical baffling members with a central hole (CH) and holes (1) near its edge, i.e., located in the peripheral region of the semispherical baffle, an end view of which may be seen in FIG. 2 and a side view in FIG. 3. In FIG. 1, the baffles A, B, C, and D are shown in cross section taken through their center.

Figure 3:
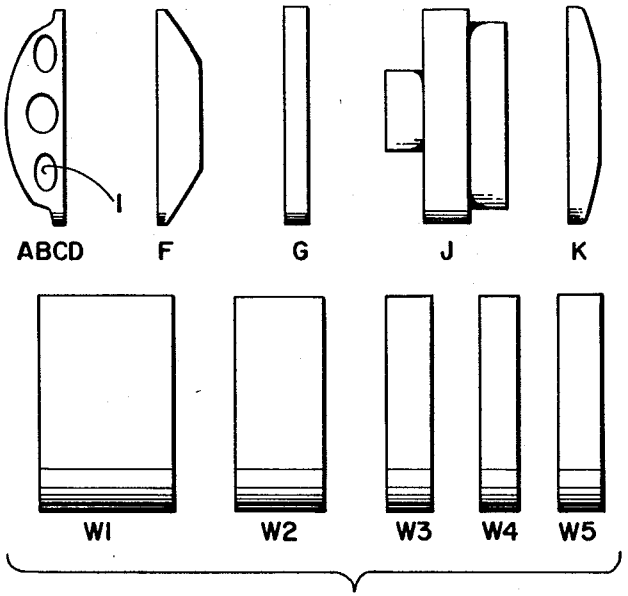
FIG. 3 illustrates in a side view the spacers W1 through W5 and other parts shown in FIGS. 1 and 2 and identified by the same letters.

F is a flange member having a central truncated conical portion with an opening at the apex i.e., at the plane of truncation of the conical portion facing towards the entrance end of the silencer, i.e., to the left in FIG. 1, an end view of which may be seen in FIG. 2 and a side view in FIG. 3.

G is a flat annular disc, i.e., a flat disc with a centrally located hole, a cross section of which is shown in FIG. 1 an end view of which may be seen in FIG. 2, and a side view of FIG. 3.

H is a hollow cylindrical member having an internal diameter large enough to fit over the barrel of a gun (not shown), a sectional view of which may be seen in FIG. 1, and an end view of which may be seen in FIG. 2.

J is an internally threaded barrel fitting with a thread 4 that matches that thread on a gun barrel, and having holes 5 located in the region between said thread and the periphery of said barrel fitting, a sectional view of which may be seen in FIG. 1, an end view of which may be seen in FIG. 2 and a side view in FIG. 3.

K is a baffle formed in the shape of a quasi-parabolic disc with the focus point facing towards gun muzzle and a dispersion area at the holes 5 in the barrel fitting J and having a centrally located hole, a sectional view of which is shown in FIG. 1, and end view of which may be seen in FIG. 2, and a side view in FIG. 3.

W1 through W5 are each a hollow cylindrical spacer, a sectional view of which is shown in FIG. 1, and end view of which is shown in FIG. 2, and a side view of which is shown in FIG. 3.

O is a cylindrical tube comprising the outer silencer tube and is shown in end view in FIG. 2 and in sectional view in FIG. 1.

P is a chamber shown in FIG. 1 formed by the interior wall of said silencer tube O, the forward facing side of annular disc G, the rearward side of the barrel fitting J, and the exterior of the cylindrical member H.

Q is a chamber shown in FIG. 1 formed by the interior wall of the hollow cylindrical space W1, the forward facing side of the barrel fitting J, the rearward facing concave side of disc K.

R is a chamber shown in FIG. 1 formed by the interior wall of the hollow cylindrical spacer W2, the forward or convex side of the disc K, the rearward or convex side of the baffle A.

S is a chamber shown in FIG. 1 formed by the interior wall of the hollow cylindrical washer W5, the forward or concave side of the baffle D, the rearward side of the flange member F.

T is a chamber shown in FIG. 1 formed by the interior wall of the hollow cylindrical spacer W2, the forward side of the flange member F, the rearward or convex side of the baffle A.

Referring now to the FIG. 1 there is seen a longitudinal section through the outer tube and all of the elements. The path of the projectile through the silencer is shown by arrows 6. The elements A, B, C, D, F, G, H, J, K, W1, W2, W3, W4, and W5 in FIG. 3 are inserted in the tube O in the order shown, but first they are fusion welded together to form a single unit.

The unit comprised of the fusion welded assembly of elements A, B, C, D, F, G, H, K, W1, W2, W3, W4 and W5 is press fitted into the outer silencer tube O. The rear part of the silencer comprising the disc G and the outer silencer tube O are fusion welded together. The front, or exit end, of the silencer is composed of the last flange F and outer silencer tube O. The silencer tube O is peened over to the outer edge of the flange F at the end, and the two are fusion welded together. A silencer thus assembled and installed on the threaded muzzle of a gun (firearm or cannon) has produced vastly superior silencing as compared to prior devices which have been in use.

As thus assembled, this single unit acts as a silencer, flash suppressor, and recoil reducer by so internally deflecting the discharge gases and sound waves to cancel and muffle them. Once the projectile is discharged through the gun muzzle inserted into the cylindrical member H and the threaded barrel fitting J, gases and sound waves travel in the path 6, encounter an obstruction, or baffle, formed by the disc K, and are deflected by the parabolic shape of the disc K towards holes 5 in the periphery of barrel fitting J. The gases and sound waves pass through the holes 5 and enter the tuned chamber P where their velocity carries them rearward to the surface of the flat annular disc G. There they strike the surface of the disc G and are reflected forward towards the barrel fitting J where they encounter incoming gas and the next one half cycle of sound waves. When the two out of phase sound waves meet at the entrance of the tuned chamber P they substantially cancel each other virtually eliminating the sound. The result of the cancellation of the sound waves is the conversion of sound wave energy to heat energy.

Other portions of the discharge gases and sound waves pass through hole CH in disc K and encounter an obstruction, or baffle, formed by the quasi-spherical baffle A, and are deflected within the chamber R where they strike the interior wall of silencer tube O, the face of baffle A and the forward facing side of disc K. Some of the gases and sound waves are forced through the holes 1 in the baffle A where they are again deflected and pass on through holes 1 in baffle B where further deflection causes them to pass through holes 1 in baffle C, and so on through holes 1 in baffle D where they enter chamber S. At each semispherical baffle A, B, and C, the remainder of the discharge gas and sound waves pass through the hole in their center and encounter an obstruction, or baffle, formed by the following semispherical baffle and are deflected towards the periphery thereof and then forced through holes 1 in the following baffle where they are again deflected and pass through holes 1, until they enter chamber S. The remainder of the discharge gas and sound waves pass through central holes and enter the chamber S. At each semispherical baffle, the remaining gas and sound waves take a nearly direct path through the central hole while the deflected gas and sound waves take a circuitous path.

Due to the delay of the passage of the gases and sound waves through the semispherical baffles, they are out of phase with the gases and sound waves passing directly through the central hole. At each semispherical baffle, they tend to cancel and when they meet in chamber S they tend to cancel any remaining sound waves and thus eliminate sound. Further passage along the central hole out of the baffle F and into chamber T begins the process again through the next series of semispherical baffles.

The spacing of the semispherical baffles also determines the frequency that the primary discharge gas and sound wave frequency is converted to and also the lower frequencies that are cancelled when the primary gas and sound waves passing through the central hole are deflected by the semispherical baffles and bounce between the surface of one semispherical baffle to the surface of the adjacent baffle and the bounce from the interior side of the silencer. The formula for the frequency conversion of the primary discharge gas and sound wave frequency to a frequency, preferably the ultra-sound is: $\lambda = v/f$, where $\lambda$ is the distance in feet that the sound waves travel between said baffles, v is the velocity in feet per second of the discharge sound waves which is determined by the gases in the silencer, and f is the frequency in hertz that the sound waves are to be converted to.

The formula for the out of phase cancellation of the sound waves passing through the central hole by the bounce between the baffles and the interior wall of the silencer is:

$$\frac{1}{\frac{d}{v} \times 2},$$

where d is the total distance that the sound wave travels before intersecting the sound wave passing through the central hole, v is the velocity of the sound wave in the silencer at the point of out of phase cancellation.

I claim:

1. A silencer to be fitted on the muzzle of a firearm for firing a projectile having a barrel of known caliber and outside diameter, said barrel having a longitudinal axis comprising:

(a) a cylindrical silencer tube having a longitudinal axis;

(b) means for attaching said cylindrical silencer tube to said muzzle of said firearm, such that said longitudinal axis of said cylindrical silencer tube is coaxially aligned with the longitudinal axis of said barrel;

said attaching means for said cylindrical silencer tube having positioned in its interior a cylindrical mounting element disposed for threading upon the muzzle of said barrel, said cylindrical mounting element containing a central, threaded hole and a plurality of additional holes parallel to said longitudinal axis of said cylindrical silencer tube, said plurality of additional holes being substantially circularly disposed around said central hole of said cylindrical mounting element, said attaching means for said cylindrical silencer further having a tubular member, and said cylindrical mounting element having a shoulder for fastening thereto of said tubular member (1) said tubular member having an outside diameter and having an inside diameter large enough to pass over said barrel, said tubular member being secured at one end thereof to the shoulder of said mounting element, said tubular member having a flat annular disc member pressed opposite said cylindrical mounting element (2) said flat annular disc member having an inside diameter equal to said outside diameter of said tubular member and having an outside diameter equal to the inside diameter of said cylindrical silencer tube, said flat annular disc member being welded to said tubular member and to one end of said cylindrical silencer tube whereby the other end of said cylindrical silencer tube is supported in space by said cylindrical mounting element; and (d) a quasi-parabolic disc positioned within the interior of said cylindrical silencer tube, said quasi-parabolic disc having a centrally located hole for the passage of said missile and gas, and having a focus point at the end of said muzzle and an annular dispersion area at the center of said additional holes circularly disposed around the threaded hole of said cylindrical mounting element, whereby said quasi-prabolic disc directs said gas and sound waves from said muzzle back through said additional holes circularly disposed in said cylindrical mounting element.

2. The device of claim 1 further comprising:

(a) a hollow cylindrical spacer for spacing said quasi-parabolic disc from said cylindrical mounting element, said quasi-parabolic disc, and spacer, and said cylindrical mounting element being firmly secured together to form a group, whereby said quasi-parabolic disc directs the gas and sound waves from said barrel back to said additional holes circularly disposed around said threaded hole of said mounting element.

3. The device of claim 2 wherein a chamber formed by said cylindrical silencer tube, said tubular member, said cylindrical mounting element, and said flat annular disc member is selected to be of a length, as measured between the forward facing side of said flat annular disc and the rearward facing side of said mounting element for optimum cancellation of sound by wave interference between gas and sound waves directed by said quasi-parabolic disc back through said additional holes circularly disposed in said cylindrical mounting element around said threaded hole into said tuned chamber and reflected by said flat annular disc.

4. The device of claim 1 further comprising:

(a) a plurality of elements positioned in the interior of said cylindrical silencer tube disposed for guiding expanded gases and transmitting sound waves from said centrally located hole of said quasi-parabolic disc, said elements each having a centrally located hole, and each being concentrically positioned along said axis of said silencer tube, each of said elements comprising a hollow semispherical baffle having its apex facing said muzzle and having an array of holes substantially circularly disposed around said centrally located hole;

(b) a flange member positioned within the interior of said cylindrical silencer tube between two groups of said elements, said flange member having a central conical section having its apex facing said muzzle with a centrally located hole at the apex thereof, and a truncated conical section supporting said central conical section, and the base of said truncated conical section facing said muzzle, said central conical section and said truncated conical section being concentric with said silencer tube axis;

(c) a plurality of hollow cylindrical spacers having an outer diameter smaller than the inside diameter of said cylindrical silencer tube, said spacers separating said elements and said flange member from each other.

* * * * *